United States Patent [19]

Erwin

[11] Patent Number: 4,509,780

[45] Date of Patent: Apr. 9, 1985

[54] POSTAGE ACCESS DOOR FOR POSTAGE METERS

[75] Inventor: Timothy R. Erwin, Trumbull, Conn.

[73] Assignee: Pitney Bowes Inc., Stamford, Conn.

[21] Appl. No.: 437,426

[22] Filed: Oct. 28, 1982

[51] Int. Cl.[3] ..... B65D 27/30; B65D 33/34; B65D 55/06

[52] U.S. Cl. ..... 292/307 R; 101/91; 292/145

[58] Field of Search ..... 292/307, DIG. 63, 145; 101/91, 92

[56] References Cited

U.S. PATENT DOCUMENTS

| | | | |
|---|---|---|---|
| 164,800 | 6/1875 | Brooks | 292/307 R |
| 311,910 | 2/1885 | Moeller | 292/175 |
| 2,009,490 | 7/1935 | Gay | 101/91 |
| 3,147,607 | 9/1964 | Calvano et al. | 292/49 |
| 3,603,629 | 9/1971 | Windham | 292/145 |

FOREIGN PATENT DOCUMENTS

| | | | |
|---|---|---|---|
| 865089 | 4/1961 | United Kingdom | 292/307 R |
| 420746 | 8/1974 | U.S.S.R. | 292/307 R |

*Primary Examiner*—Gary L. Smith
*Assistant Examiner*—Russell W. Illich
*Attorney, Agent, or Firm*—Joseph A. Sawyer, Jr.; David E. Pitchenik; William D. Soltow, Jr.

[57] ABSTRACT

A sealing apparatus for identifying access to a postage meter is disclosed. The apparatus comprises a paper seal membrane which is partially exposed to the outside of the postage meter. The membrane is punctured providing access to a locking member within the postage member that allows for the opening of a postage meter door. The locking member has a slidable bolt that is easily engaged after the sealing membrane is punctured. Once the bolt is moved to an open position, access to the setting of the meter or the keyboard is easily accomplished. In accordance with this embodiment, the seal membrane once punctured must be replaced when meter door is closed. Thus, unauthorized access thereto is easily identified inasmuch as only authorized personnel will have access to the seal membrane that can be replaced thereto.

15 Claims, 4 Drawing Figures

POSTAGE ACCESS DOOR FOR POSTAGE METERS

BACKGROUND OF THE INVENTION

This invention relates to a tamper-proof sealing device that is particularly adapted for use in the housings of postage meters.

In many countries, requirements are provided which regulate the use of postage meters and their security against unauthorized use or vandalism. There have been several systems devised or suggested in this regard, but none have experienced wide-spread commercial use because of their complexity, cost or ineffectiveness. Many of these prior art devices are cumbersome, heavy mechanisms that are not only costly to manufacture, but are difficult to install and use. Additionally, other security devices are difficult to repair and/or to easily find replacement parts for. In addition, when it is desirable to convert a normally secure postage meter into a more tamper-resistant closure, an inexpensive and relatively simple device is needed. While simplicity and convenience are desirable in a security system, the primary concern should be the effectiveness of the device.

In some countries outside of the United States, the government through its responsible agencies requires tamper-proof access mechanisms that prevent unauthorized access to the interior of the postage meters. There is therefore a need for a relatively inexpensive yet effective means for indicating unauthorized use of postage meters and the like.

Prior art construction of security seals or other types of security devices generally consists of a number of components that are expensive to fabricate. Several of such seals or devices require a tool in order that they can be installed or closed. Other prior art constructions heretofore known do not totally eliminate the possibility of undesired tampering or manipulation. A construction described in the prior art comprises a sheet metal strip drawn through the opening or openings of an article which is to be sealed. After the sheet metal strip is flexed over upon itself, it can be riveted at both of its ends by tongs or pliers. The rivet location is subsequently covered with a plastic cap. With this construction seal, there is the drawback that riveting of the sheet metal strip is not undertaken in a completely faultless manner. Tampering or manipulations for the purpose of providing a false seal or giving the appearance that the article has in fact been sealed is possible.

According to another state of the art construction of a security seal, both ends of a flexible strip have associated therewith rather bulky closure elements. Thus, this construction of seal cannot be employed in those instances in which the opening or openings of the article to be sealed is small, especially in conjunction with slot-shaped openings or apertures.

In addition, with this prior art construction of seal, the catch elements of the locking elements (even when the seal was closed) are freely accessible so that it is easy to provide a false or improper seal of the article. Other known seals have been employed on security containers and other repositories of valuable materials as a safeguard against tampering or unauthorized opening, but they are generally difficult to install or expensive for continuing use. While these seals do provide assurance that unauthorized openings have not occurred, such seals can generally be circumvented. This is done by anyone having access to a supply of seals by simply replacing a broken seal with a new one. Counterfeiting seals also would not be difficult for someone willing to go to the considerable time and expense involved.

In some containers, seals having a very high degree of assurance are required to indicate if unauthorized access has occurred. Some known seals to be used on postage meters, for example, do have a high degree of integrity but at a relatively high cost in both time and money. When using presently available devices to assure that a seal has not been replaced, a plurality of intricate and expensive means have been attempted.

There have been many sealing devices utilizing a frangible or destructible membrane and a device such as these has been described in Dutch patent application No. 7,412,131 or U.S. Pat. Nos. 2,142,048, 3,983,645 and 3,924,800. Devices like these are used for dispatching documents in transportation bags. One such device takes the form of a flat envelope having along one of the edges a zip fastener which, in closed position, is sealed by means of a rupturable or frangible sealing member. In order to be able to establish afterwards that the transportation bag has been opened by a person unauthorized to do so, one must be able to ascertain if the seal is original or a replacement. With such a sealing device, it would be possible to reapply the sealing member quickly and without use of aids, thus giving the impression that the sealing member was never broken. In the sealing device disclosed in the above-noted Dutch patent, the elastic means which are to be deformed are formed by resilient lips projecting from the shaft portion of the sealing member. In the head of the sealing member there is formed a slit wherein a special tool can be engaged for twisting said sealing member in order to break same. It is obvious, however, that in addition to being complex, a design such as this leads to a relatively high cost for the sealing members, especially upon continued use. There is a need to provide a simple and inexpensive sealing device of the type that will be described herein in which no specific or expensive tool is required to break the sealing member thereof.

The present invention provides a destructible or frangible paper seal that is intimately connected to the locking mechanism in such a manner that the opening of the lock will cause destruction of this paper seal or membrane.

SUMMARY OF THE INVENTION

It is therefore an object of this invention to provide a postage meter sealing means devoid of the above-noted disadvantages.

Another object of this invention is to provide a tamper-indicating sealing device which may be attached to doors, boxes, or containers housing postage meters or any other type of valuable object.

Another further object is the provision of an efficient postal meter locking means that may be manufactured easily according to various strict government specifications and yet will satisfy these same governmental security requirements.

A further object is to provide a postage meter security means that is a highly visible seal whose destruction is readily determined.

Another further object is to provide a simple sealing element for postage meters or other security uses, that is clearly exposed and can inexpensively be replaced after use.

Still a further object of this invention is to provide a paper sealing means that is easily replaced or installed when properly destroyed by authorized personnel.

A still further object of this invention is to provide a sealing means for postage meters which fully satisfies the security requirements of many countries.

The foregoing objects and others are accomplished in accordance with this invention by providing a novel sealing means comprising a frangible paper seal or membrane at least partially exposed to the outside of the cover or skirt of the postage member. Immediately below the membrane is a door or other opening means that permits access to the inner portion of the meter. In the preferred embodiment there is a slidable bolt that is easily engaged after the paper seal is punctured. Once the bolt is moved to the open position, access to setting of the meter or keyboard is easily accomplished. The postage meter security device comprises an access door, a door locking means, and a security membrane indicating means, said access door opening into the interior of said postage meter and movably engaged to and with said door locking means, said door locking means having an integral extension projecting outwardly and adapted to be manually operated to effectuate this opening and locking of said access door, said door locking means extension not visible unless said security membrane indicating means is punctured.

The paper seal covers an access aperture through which the means projecting extension of the sliding means is accessible. The paper seal or membrane is generally punctured with any suitable pointed device. When the paper is punctured or destroyed, the metal bolt holding the the access door shut is visible. The bolt is then moved back to open the door and further rips the paper seal. The open door then permits access to the postage setting mechanism. After the meter is set, the used seal is replaced by a new one and the door is shut and locked by the spring loaded bolt.

Any suitable seal or membrane may be used in this invention. Typical membranes are made of paper, thin frangible synthetics, fabrics and the like. The bolt is preferably made of metal; however, any suitable material such as plastic may be used for the bolts.

The paper seal or membrane is preferably square in configuration so that it is easy to install and need not be aligned in any particular set position. However, any suitable configuration may be used. Some countries issue their own easily identifiable papers so that counterfeit papers or seals cannot be substituted when a seal is broken by unauthorized personnel.

The device of this invention may be used whenever security is desired on any container. It may be attached to doors, boxes or containers already in use or may be built into any new structure. In addition to postal meters, the device of this invention may be used in safe deposit boxes, mailing containers, or any device requiring a security lock. This device would comprise in combination a container housing, an access door positioned in said housing, a door locking means and a destructible sealing membrane, said container housing having an aperture extending from the outside of said container housing to said door locking element located within and adjacent to the inside surface of said container housing, said locking element slidably positioned in contact with said access door and adapted to be moved out of contact with said door, said sealing membrane completely enclosing the inside container surface of said opening and sealing said aperture from the atmosphere.

BRIEF DESCRIPTION OF THE DRAWINGS

The preferred embodiment is illustrated in the accompanying drawing and description.

FIG. I is a perspective view of the sealed postage meter showing the preferred location of the sealing unit means and access door in the skirt or cover of the meter.

Figure 1:
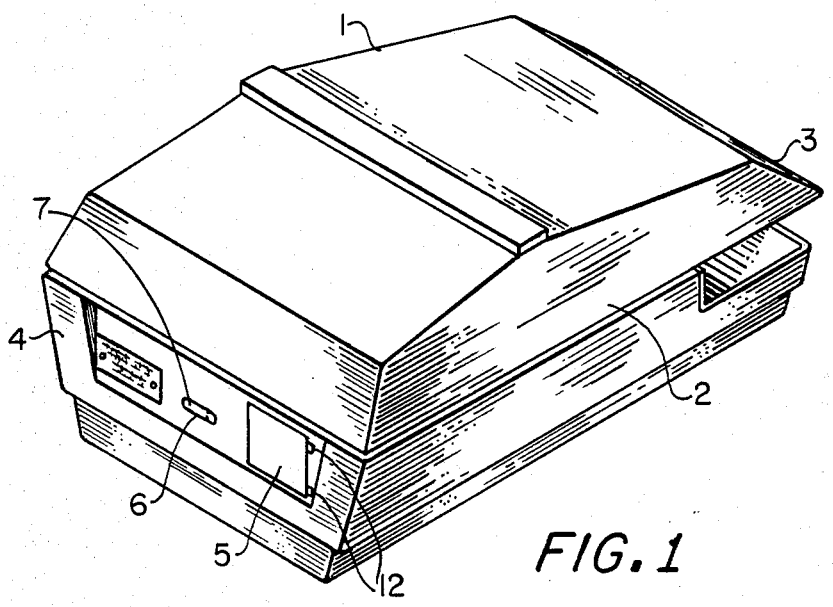
Figure 3:
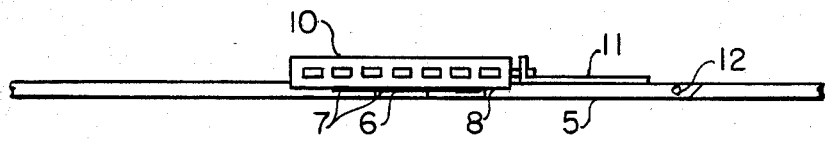
Figure 2:
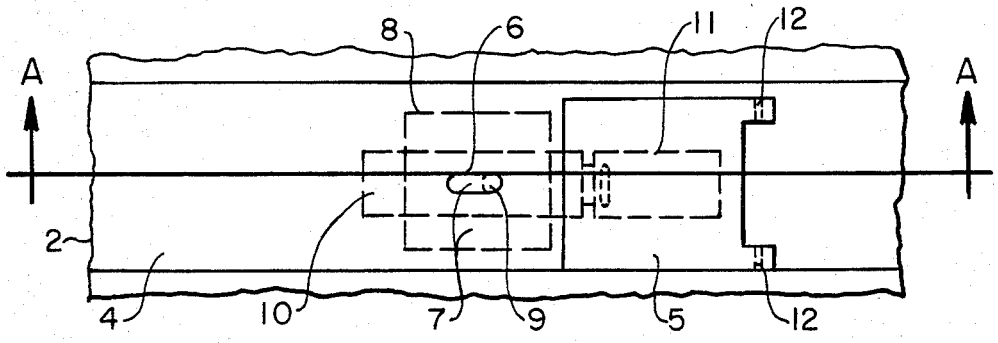
Figure 4:
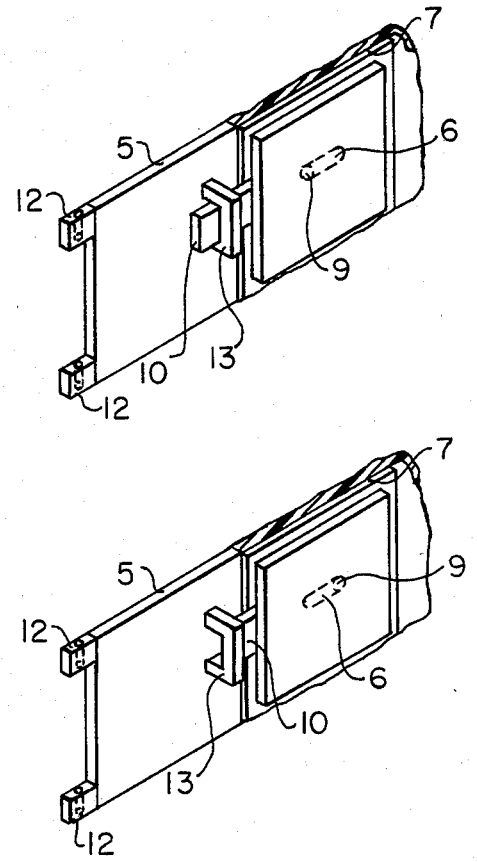

FIG. II is a top plan view of the preferred construction of the sealed access door and access mechanism of this invention.

FIG. III is a cross-section and view of the security seal and access mechanism of this invention taken along the line A—A of FIG. II.

FIG. IV is a perspective view of the locking mechanism from the interior of the postage meter.

DESCRIPTION OF THE PREFERRED EMBODIMENT

In FIG. I, postage meter 1 is equipped with a container housing, cover or skirt 2 that encloses the entire setting mechanism for inputting the meter mail value. The front 3 of the postage meter usually contains the external controls that operate the meter during use. The back of rear panel 4 of the postage meter houses the access door 5 and contains the access aperture 6 later defined. A paper seal or destructible sealing membrane 7 is placed within the rear panel 4 in such a manner that it completely covers aperture 6 and prevents access to the mechanism that opens access door 5. Generally aperture 6 is of an elongated elliptical configuration, but can take any other desirable and suitable form. The paper or security membrane indicating means seal 7 can be punctured with any suitable pointed object to thereby gain access to the access door 5 opening mechanism. Once door 5 is opened, the interior meter or keyboard may be set to the desired value. After the operation is completed, paper 7 is replaced with a new paper seal that is intact, the door 5 is closed and the security is set for the next authorized use.

In FIG. II, a top plan view of a portion of the rear panel 4 of the postage meter housing 2. In housing 2 is located externally available aperture 6 which is completely sealed by paper seal 7. FIG. III shows a cross-section of the security seal and access mechanism of this invention taken across line A—A of FIG. II.

Paper seal 7 extends at least across the total periphery of aperture 6 and preferrably beyond as shown by paper seal edges 8. Once paper seal 7 is punctured bolt handle sliding means or door locking handle means 9 is pushed horizontally to slide bolt 10 away from the locked position in door 5 thereby opening door 5 to gain access to the interior of postage meter 1. Thus, the necessary setting of the postage meter may take place once the access door 5 is opened.

Located at the end of bolt 10 closest to door 5 and attached to door is a locking latch 11 which keeps door 5 locked when bolt 10 is in its closed position. As bolt 10 is slid away from door 5, latch 11 is released, allowing door 5 to swing open. Door 5 is movable via door hinges 12 and is opened outwardly once latch 11 has been disengaged.

The puncturing of paper seal 7 indicates either authorized or unauthorized use setting of the postage meter. The device is so constructed that the seal must be mutilated beyond the possibility of reuse before access may be obtained to the interior of the container housing. Some countries such as West Germany and Italy issue their own identifiable paper that prevents the unauthorized use of the postage meter and replacement with any paper not issued by the various governments. Some countries such as Italy also have an official stamp on the paper that identifies it as officially issued seals. Other countries make their paper seals from proprietary compositions that can be identified by an easy analysis. Nowhere, however, has the novel and specific configuration of this invention been used with these officially issued paper seals.

It is preferred that the paper seal 7 be a square rather than a different configuration. This is the preference since the paper may be placed simply to fit in any position without having to fit and turn a configuration not of concentric design or equilateral in section.

FIG. IV shows the specific engagement of bolt 10 relative to door 5 in both the locked and unlocked positions. Spring loaded bolt 10 may be moved to its unlocked position once the membrane seal 7 is destroyed. Once the bolt 10 is moved to its unlocked position, door 5 may be swung open and the interior of the postage meter is accessible to the user. Door hinges 12 may be of any suitable configuration that permits easy movement once the bolt 10 is moved. Aperture 6 is shown by a dotted line to be adjacent to bolt 10 and bolt handle means 9. A door catch 13 is part of door 5 and is adapted to receive and lock with bolt 10 when the door is closed and locked.

By designing a security seal for postage meters that is universally accepted would be extremely beneficial in not only covering the costs of these meters, but also in requiring only one type meter to be marketed and manufactured. Other important advantages are apparent because of the simplicity of construction and use of the device. While this description illustrates the preferred embodiments of the invention, it is to be understood that other obvious modifications will occur to those skilled in the art upon a reading of this disclosure. It is intended that these be included within the spirit of this invention. Also, while the present security sealing means is described herein in terms of its preferred use with postage meters, it can be used for other suitable purposes.

What is claimed is:

1. A security sealing means comprising in combination a container housing, an access door positioned in said housing, a door locking means and a destructible sealing membrane, said container housing having an aperture extending from the outside of said container housing to said door locking means located within and adjacent to the inside surface of said container housing, said locking means slidably positioned in contact with said access door and adapted to be moved out of contact with said door, said sealing membrane completely enclosing the inside container surface of said opening and sealing said aperture from the atmosphere, said door locking means being exposed only by puncturing said sealing membrane, said door locking means and said sealing membrane are in contact with each other at an intended fracture location, wherein movement of the door locking means to open the access door further rips the sealing membrane.

2. The security sealing means of claim 1 wherein said sealing membrane when punctured exposes said door locking means.

3. The security sealing means defined in claim 1 wherein said door locking means is movably mounted so as to be in locking contact with said access door in one position and adapted to unlock said door when moved to a position out of contact with said door.

4. The security sealing means defined in claim 1 wherein said container housing is a postage meter housing.

5. The security sealing means of claim 1 wherein said sealing membrane is made of a proprietary paper, and is adapted to be removed and replaced from and in said housing.

6. The security sealing means of claim 1 wherein said door locking means has a handle portion that is exposed when said membrane is punctured.

7. The security sealing means of claim 1 wherein said membrane is of an equidimensional configuration.

8. The security sealing means of claim 1 for inset aperture is of an elongated elliptical configuration and said door locking means is located within the periphery of said configuration.

9. A postage meter security sealing device comprising an access door, a door locking means, and a security membrane indicating means, said access door opening into the interior of said postage meter and movably engaged to and with said door locking means, said door locking means having an integral extension projecting outwardly and adapted to be manually operated to effectuate the opening and locking of said access door, said door locking means extension not accessible unless said security membrane indicating means is punctured, said door locking means being movably mounted so as to be in locking contact with said access door in one position and adapted to unlock said door when moved to a position not in contact with said door, said security indicating means and said door locking means are in contact with each other at an intended fracture location, wherein the movement of said door locking means further rips the security indicating means.

10. The postage meter security device of claim 9 wherein said door locking means and said security membrane indicating means are immediately cooperatively adjacent to each other.

11. The postage meter security device of claim 9 wherein said door locking means and said security membrane indicating means are in a horizontal alignment whereby said door locking means is nearer to the interior portion of the postage meter.

12. The postage meter security device of claim 9 wherein said security membrane indicating means is adapted to be removed and replaced from and in said security device.

13. The postage meter security device of claim 9 wherein said security membrane indicating means is constructed of a proprietary paper.

14. The postage meter security device of claim 9 wherein said security membrane indicating means is of an equidemensional configuration.

15. The postage meter security device of claim 9 wherein said door locking means is located internally of the postage meter, and both said security membrane indicating means and said access door are located at least in part externally of said postage meter.

* * * * *